US012504263B2

(12) United States Patent
Reed

(10) Patent No.: US 12,504,263 B2
(45) Date of Patent: Dec. 23, 2025

(54) SEATING DIE

(71) Applicant: Jesse Reed, Redford, NY (US)

(72) Inventor: Jesse Reed, Redford, NY (US)

( * ) Notice: Subject to any disclaimer, the term of this patent is extended or adjusted under 35 U.S.C. 154(b) by 0 days.

(21) Appl. No.: 18/435,333

(22) Filed: Feb. 7, 2024

(65) Prior Publication Data

US 2024/0263930 A1 Aug. 8, 2024

Related U.S. Application Data

(60) Provisional application No. 63/483,583, filed on Feb. 7, 2023.

(51) Int. Cl.
*F42B 33/00* (2006.01)

(52) U.S. Cl.
CPC ..... *F42B 33/005* (2013.01)

(58) Field of Classification Search
CPC ..... F42B 33/001; F42B 33/005
See application file for complete search history.

(56) References Cited

U.S. PATENT DOCUMENTS 2,700,915 A 2/1955 Pattison
2,719,453 A * 10/1955 Bahler ..... F42B 33/005 86/43
2,741,148 A * 4/1956 Thompson, Jr. ..... F42B 33/10 86/24
3,204,518 A * 9/1965 Jackson ..... F42B 33/001 86/43
3,440,923 A * 4/1969 Purdie ..... F42B 33/10 86/43
4,862,567 A * 9/1989 Beebe ..... F42B 33/005 86/43
6,244,154 B1 * 6/2001 Beebe ..... F42B 33/005 86/24
7,703,369 B1 * 4/2010 Lee ..... F42B 33/10 86/43
11,204,226 B1 * 12/2021 Lee ..... F42B 33/001
11,326,864 B1 5/2022 McPherson et al.
11,713,951 B1 * 8/2023 McPherson ..... F42B 33/005 86/24
11,874,097 B1 * 1/2024 Aerni ..... F42B 33/10
2002/0157524 A1 * 10/2002 Tuftee ..... F42B 33/005 86/23

(Continued)

FOREIGN PATENT DOCUMENTS

DE 102004046462 A1 * 4/2006 ..... F42B 33/001

*Primary Examiner* — Derrick R Morgan
(74) *Attorney, Agent, or Firm* — Downs Rachlin Martin PLLC

(57) ABSTRACT

A seating die assembly is provided that includes a die body having a longitudinal axis, a first end surface and a second end surface opposing the first end surface, the first and second end surfaces separated from each other along the longitudinal axis, an elongated cavity disposed along the longitudinal axis, a cartridge receiver defining an opening on the first end surface connected to the elongated cavity, a top punch for seating a bullet in a casing disposed at least partially within the elongated cavity and translatable within the elongated cavity along the longitudinal axis, and a biasing element disposed within the elongated cavity for urging the top punch toward the cartridge receiver to seat the bullet in the casing.

7 Claims, 6 Drawing Sheets

(56) References Cited

U.S. PATENT DOCUMENTS

| | | | | |
|---|---|---|---|---|
| 2016/0040969 | A1* | 2/2016 | Kleinschmit | F42B 33/001<br>86/43 |
| 2022/0034637 | A1* | 2/2022 | Burke | F42B 33/005 |
| 2022/0325997 | A1* | 10/2022 | Jones | F42B 33/005 |
| 2023/0349679 | A1* | 11/2023 | Burke | F42B 33/005 |
| 2024/0263930 | A1* | 8/2024 | Reed | F42B 33/005 |

* cited by examiner 100
120
D1
136
140
144
128

100
184
156
120
168

128
125
128

100
184
122
178
168
D1
176
121
180
140
144
130
132
A1
172
160
162
156
120
182
166
170
125
Dx
136
128
128

SEATING DIE

FIELD OF THE INVENTION

The present invention generally relates to ammunition preparation tools, and more specifically to an ammunition seating die.

BACKGROUND

When bullets are mounted in the ends of cartridges, the bullet is forced into the end of the cartridge with a light drive fit and is secured by frictional engagement with the cartridge. The edges of cartridges are crimped into grooves in bullets comparatively extensive machines are used.

SUMMARY OF THE DISCLOSURE

A seating die assembly is provided that includes a die body having a longitudinal axis, a first end surface and a second end surface opposing the first end surface, the first and second end surfaces separated from each other along the longitudinal axis, an elongated cavity disposed along the longitudinal axis, a cartridge receiver defining an opening on the first end surface connected to the elongated cavity, a top punch for seating a bullet in a casing disposed at least partially within the elongated cavity and translatable within the elongated cavity along the longitudinal axis, and a biasing element disposed within the elongated cavity for urging the top punch toward the cartridge receiver to seat the bullet in the casing.

BRIEF DESCRIPTION OF THE DRAWINGS

For the purpose of illustrating the disclosure, the drawings show aspects of one or more embodiments of the disclosure. However, it should be understood that the present disclosure is not limited to the precise arrangements and instrumentalities shown in the drawings, wherein.

DETAILED DESCRIPTION

A seating die for precisely loading a bullet into a cartridge is disclosed. The seating die is used to adjust the seating depth of the bullet in the case. A spring is used to set tension. The spring pushes the bullet into the cartridge and is stopped at the rim such that if additional force is applied the cartridge will not be damaged.

In an embodiment, the seating die includes a one-piece sleeve, which has a lock nut and a locking cap to put tension on the spring. The locking cap adjusts the tension on the spring. A top punch in the sleeve stops on the rim of the cartridge, and in this way the bullet is seated the same no matter the length of the cartridge. Thus, for the same specifications, the need for trimming is eliminated.

The die body includes threads to mount the die body on a known press. A bullet and cartridge are loaded onto a plunger and cartridge holder of the press. The press can be operated to move the bullet and cartridge into and out of the die body.

Figure 1:
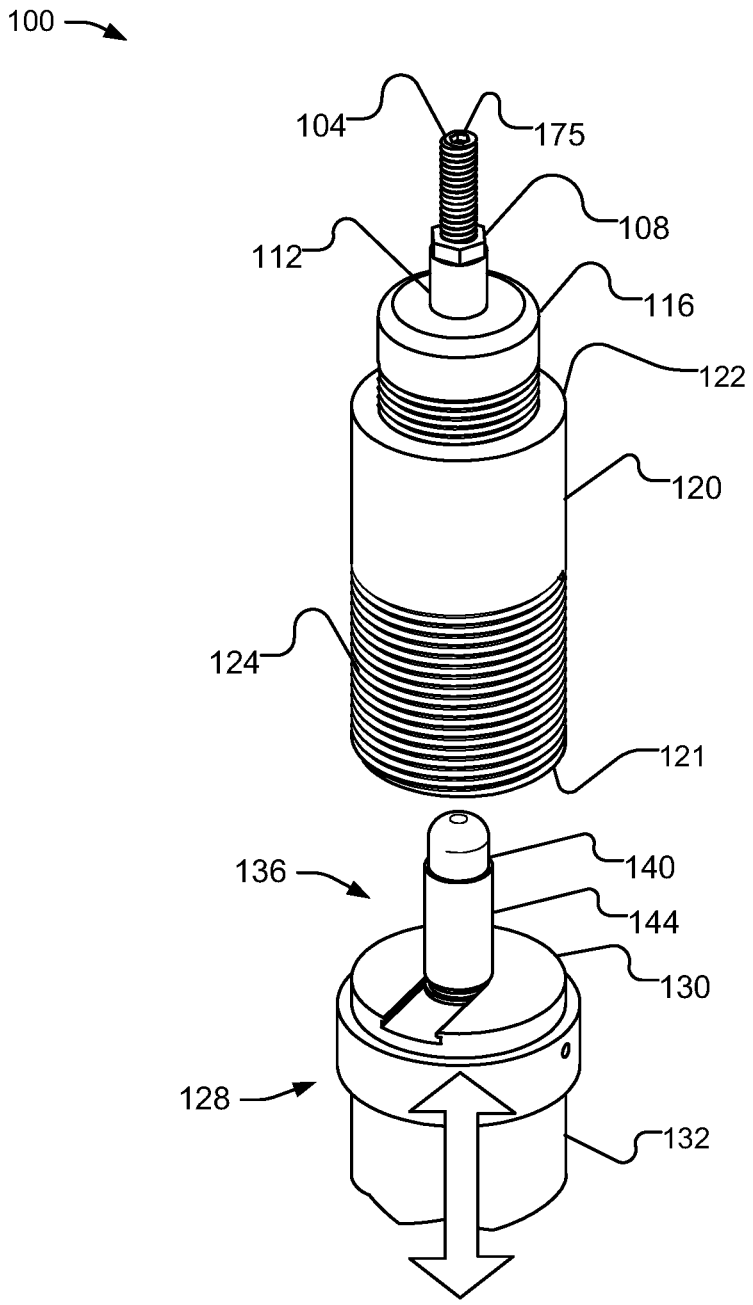
FIG. 1 is a perspective view of a seating die in accordance with an embodiment of the present invention.

A seating die 100 is shown in FIG. 1 that includes an adjustable top punch 172, a lock nut 108, a seating sleeve 112, an adjustment cap 116, and a die body 120 having a first end 121 and a second end 122, wherein the die body 120 has threads 124 to mount the seating die 100 on a press and a sleeve cavity 182. The top punch 172 may include a receiver 175 for an Allen wrench. The die body 100 is configured to engage with a cartridge holder assembly 128 that includes a cartridge holder 130 mounted on a plunger 132 that is moved up and down by the press to engage the cartridge holder assembly with the seating die body 120. The cartridge holder assembly 128 is configured to support a cartridge 136 having a bullet 140 in a casing 144.

Figure 2:
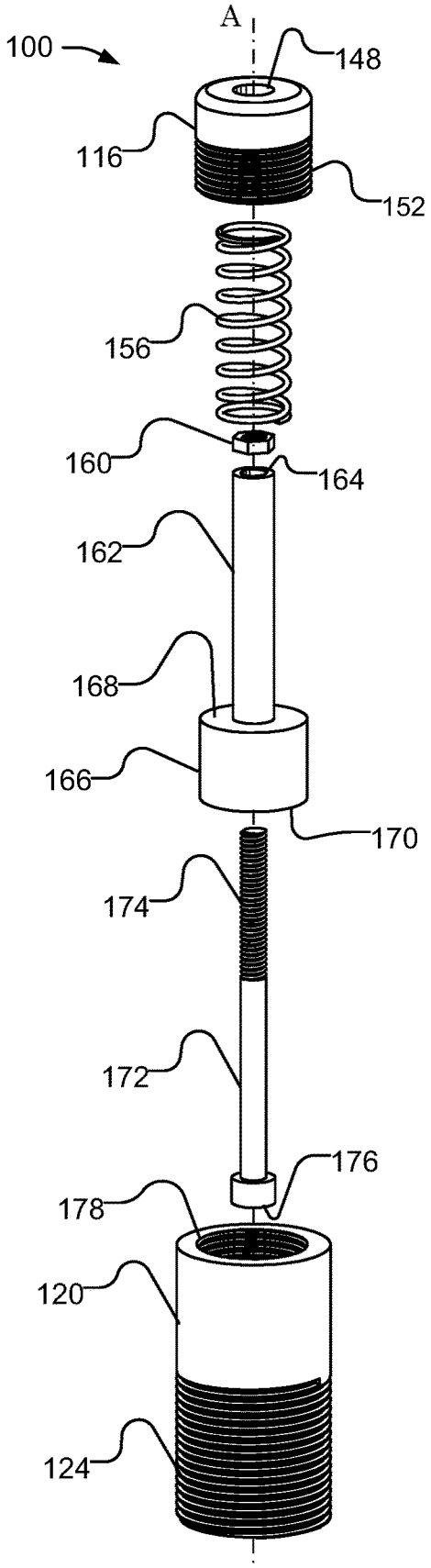
FIG. 2 is an exploded view of the seating die of FIG. 1.
Figure 3A:
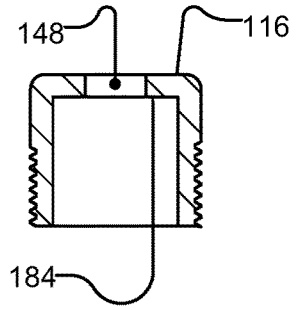
FIG. 3A is a section view of the cap of the seating die of FIG. 1.
Figure 3B:
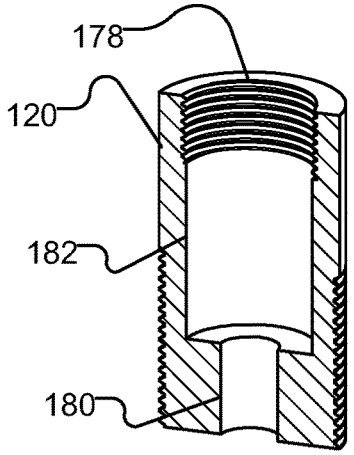
FIG. 3B is a section view of the die body of the seating die of FIG. 1.

In FIG. 2, an exploded view of the seating die 100 is shown. The adjustment cap 116 includes a sleeve passage 148 and cap threads 152. Between the adjustment cap 116 and die body 120 are a biasing element such as spring 156, a lock nut 160, a seating sleeve 162 having a punch passage 164 and connected to a die interface 166 having a top seating surface 168 and a bottom surface 170. An adjustable top punch 172 includes threads 174 and a bottom surface 176. The die body 120 incudes a threaded cap interface 178, as can be seen in FIG. 3B, which also shows a cartridge receptacle 180 and sleeve cavity 182. FIG. 3A shows a first seating surface 184 of cap 116.

Top punch 172 is assembled into the punch passage 164 of the seating sleeve 162 and secured using the locking nut 160. The assembled seating sleeve 162 and top punch 172 are assembled into the sleeve cavity 182 of the die body 120. The biasing element (spring) 156 is disposed in the sleeve cavity 182, over the seating sleeve/top punch assembly. The adjustment cap 116 is assembled onto the die body 120 with the seating sleeve 162 extending through the sleeve passage 148 of the adjustment cap 116. When the seating die 100 is assembled, the biasing element 156 is disposed between the first seating surface 184 and the second seating surface 168. The biasing element 156 tends to urge the seating sleeve/top punch toward the bullet receptacle 180 of the seating die 100.

Figures 4A, 4B, 4C, 4D:
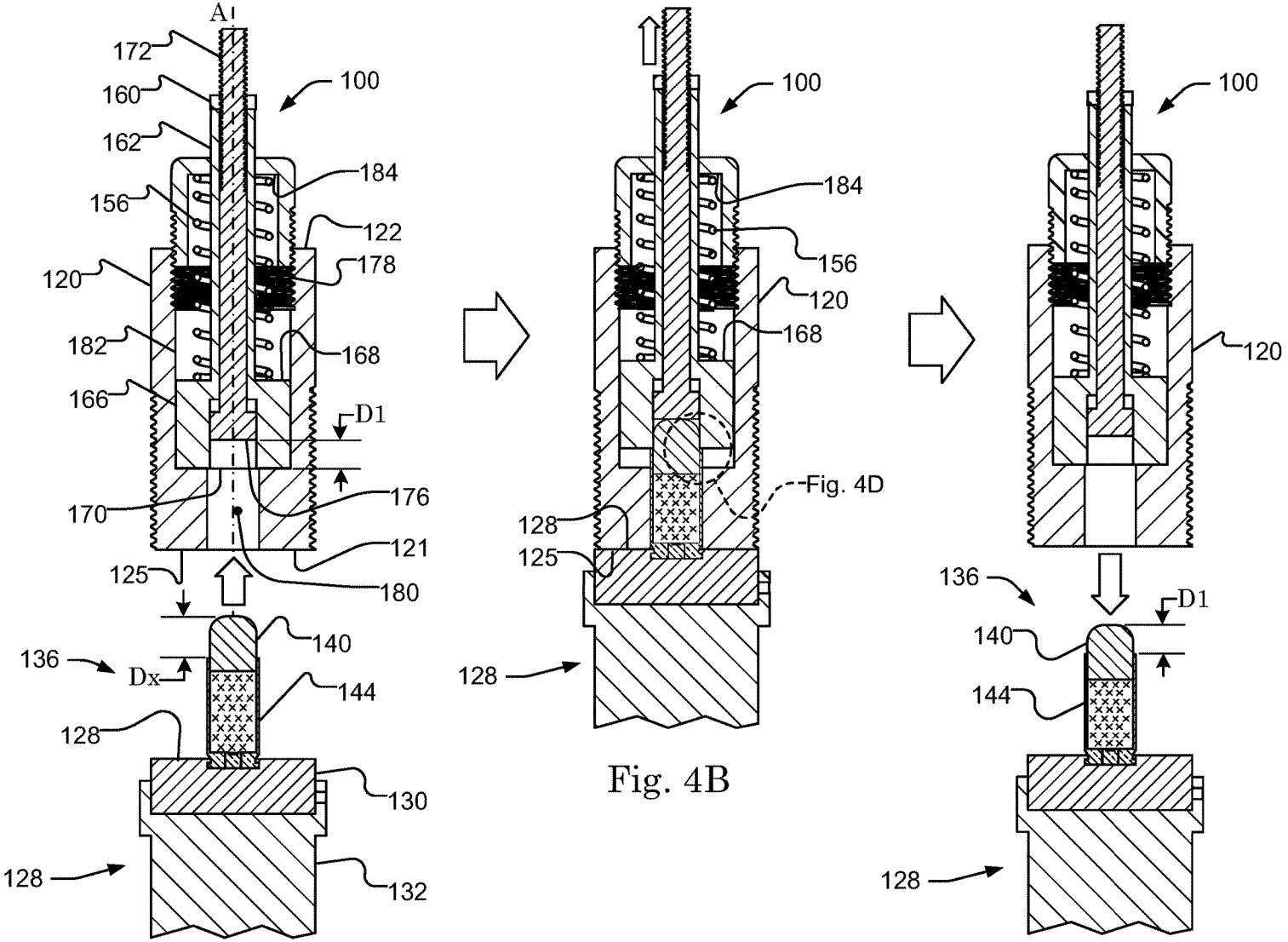
FIGS. 4A-4C are section views of the seating die shown at stages of the seating process.
FIG. 4D is a detail view of a portion of FIG. 4B.
Figure 4D:
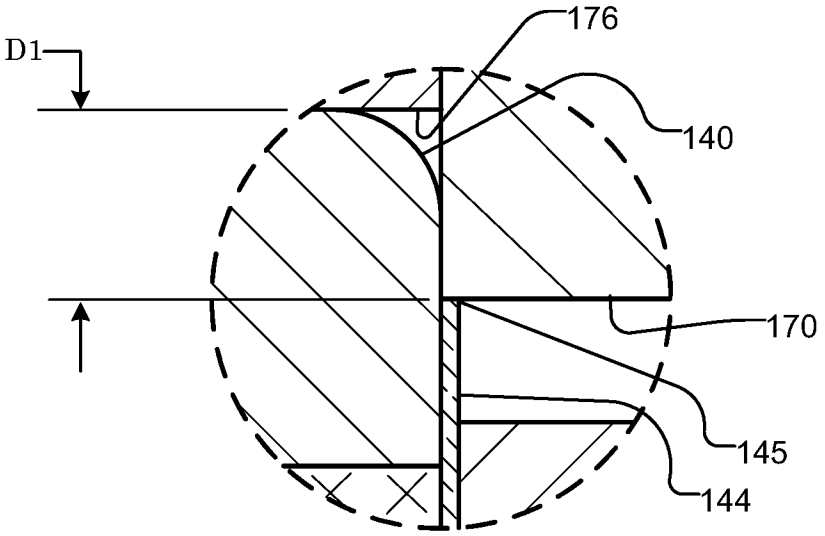

In FIGS. 4A-4D, a seating sequence is shown as the seating die 100 is engaged with cartridge holder assembly 128. A primed and loaded (with powder) cartridge 136 that includes a casing 144 and a bullet 140 assembled together is assembled onto the cartridge holder 130 as shown in FIG. 4A. The bullet 140 is seated to an arbitrary depth (indicated in FIG. 4A as Dx). The lock nut can be loosed to adjust the top punch relative to the sleeve such that the bottom surface 176 of the top punch and the bottom surface 170 of the sleeve are separated by a distance D1. The distance D1 is a desired seating depth of the bullet in the cartridge. The plunger 132 is moved upward until the top surface 128 of the cartridge holder 130 abuts the bottom surface 125 of the die body 120, as shown in FIG. 4B. The top edge 145 of the casing 144 hits the bottom surface of the sleeve 170, as can best be seen in FIG. 4D. Continued upward movement of the plunger 132 tends to move the sleeve/top punch assembly upwards. This compresses the biasing element 156, which resists the upward motion, pushing the bullet 140 into the casing 144 until it is seated as shown in FIG. 4C. The bullet 140 will be seated to the pre-set depth of D1.

Note that the ability of the sleeve 162/top punch 172 assembly to move alone the longitudinal axis A while a bullet seating force is applied by the biasing element 156 enables casing 144 and bullet 140 combinations of different lengths to be properly seated. The distance D1 can be altered to change a pre-set seating depth. As shown in FIG. 4C, the plunger 132 can be withdrawn to enable removal of the seated cartridge 190, with the bullet 140 seating in the casing 144 to the pre-set depth D1.

Figure 5:
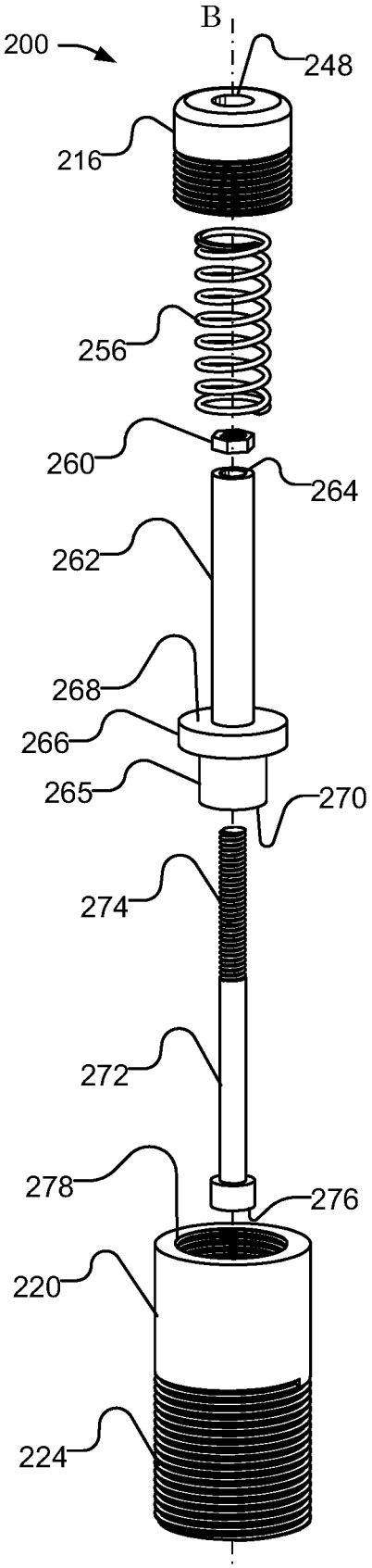
FIG. 5 is an exploded view of a seating die in accordance with another embodiment of the present invention.

In another embodiment, a seating die 200 is shown in FIG. 5 in an exploded view that includes an adjustable top punch 272, a seating sleeve 262, an adjustment cap 216, and a die body 220, wherein the die body 220 has threads 224 to mount the die 200 on a press and a sleeve cavity 282. The die body 200 is configured to engage with a cartridge holder assembly that includes a plunger that is moved up and down by the press to engage the cartridge holder assembly with the seating die body 220. The cartridge holder assembly is configured to support a cartridge having a bullet 240 in a casing 244.

Figure 6A:
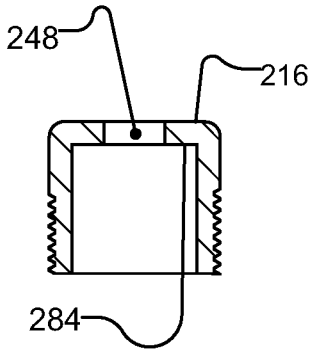
FIG. 6A is a section view of the cap of the seating die of FIG. 5.
Figure 6B:
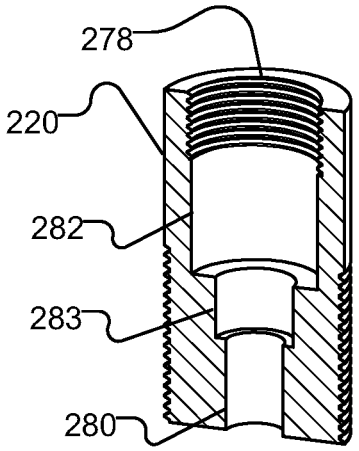
FIG. 6B is a section view of the die body of the seating die of FIG. 5.

The adjustment cap 216 includes a sleeve passage 248 and cap threads 252. Between the adjustment cap 216 and die body 220 are a biasing element such as spring 256, a lock nut 260, a seating sleeve 262 having a punch passage 264 and connected to a die interface 266 having a top seating surface 268 and a bottom surface 270. An adjustable top punch 272 includes threads 274 and a bottom surface 276. The die body 220 incudes a threaded cap interface 278, as can be seen in FIG. 6B, which also shows a cartridge receptacle 280 and sleeve cavity 282 and a seating cavity 283 disposed between the sleeve cavity 282 and the cartridge receptacle 280. FIG. 6A shows a first seating surface 284 of cap 216.

Top punch 272 is assembled into the punch passage 264 of the seating sleeve 262 and secured using the locking nut 260. The assembled seating sleeve 262 and top punch 272 are assembled into the sleeve cavity 282 of the die body 220. The biasing element (spring) 256 is disposed in the sleeve cavity 282, over the seating sleeve/top punch assembly. The adjustment cap 216 is assembled onto the die body 220 with the seating sleeve 262 extending through the sleeve passage 248 of the adjustment cap 216. When the seating die 200 is assembled, the biasing element 256 is disposed between the first seating surface 284 and the top seating surface 268 of the sleeve 262, which is also known herein as a second seating surface 268. The biasing element 256 tends to urge the seating sleeve/top punch toward the bullet receptacle 280 of the seating die 200.

Seating sleeve 262 includes a first die interface surface 263 that is configured to interface with the sleeve cavity 282 and a second die interface surface 265 that is configured to interface with the seating cavity 283.

Figure 7A:
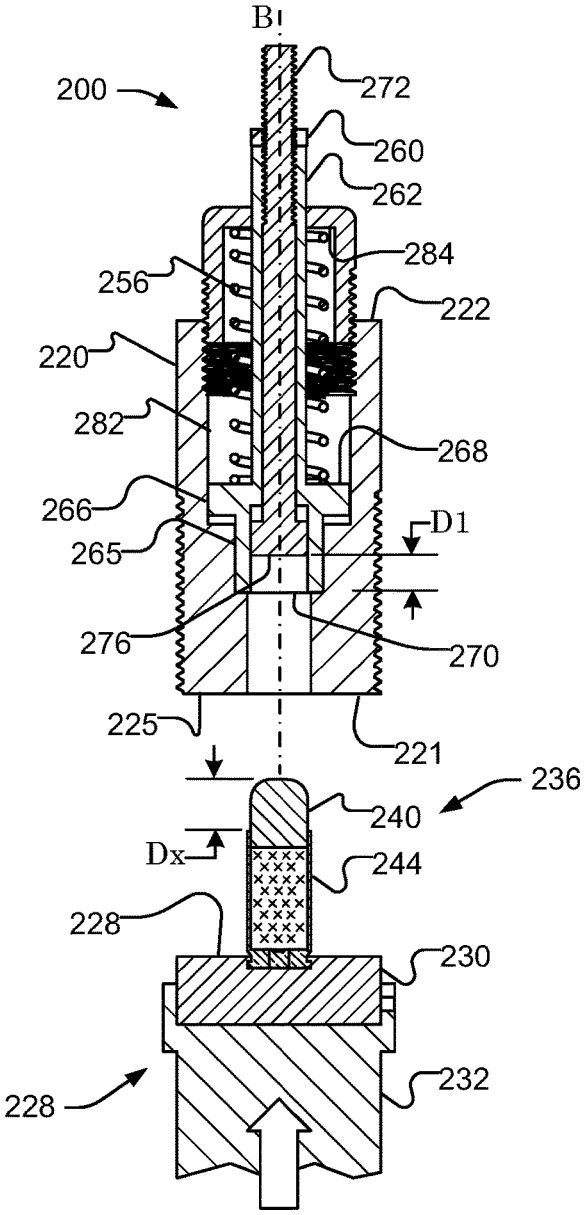
FIGS. 7A-7B are section views of the seating die shown at stages of the seating process.
Figure 7B:
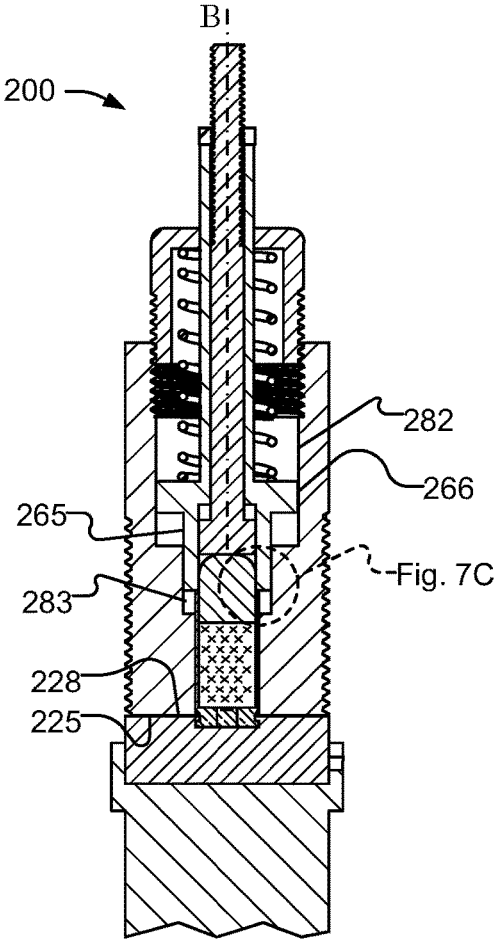
Figure 7C:
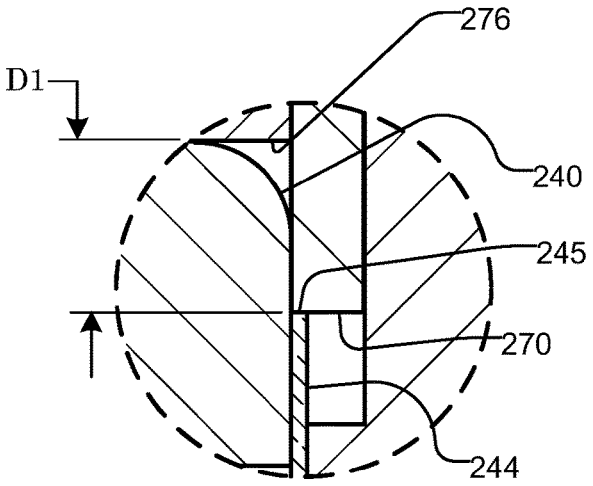
FIG. 7C is a detail view of a portion of FIG. 7B.

In FIGS. 7A-7C, a seating sequence is shown as the seating die 200 is engaged with cartridge holder assembly 228. A primed and loaded (with powder) cartridge 236 that includes a casing 244 and a bullet 240 assembled together is assembled onto the cartridge holder as shown in FIG. 7A. The bullet 240 is seated to an arbitrary depth (indicated in FIG. 7A as Dx). The lock nut 260 can be loosened to adjust the top punch 272 relative to the sleeve 262 such that the bottom surface 276 of the top punch and the bottom surface 270 of the sleeve are separated by a distance D1. The distance D1 is a desired seating depth of the bullet 240 in the casing 244. The plunger 232 is moved upward until the top surface 228 of the cartridge holder 230 abuts the bottom surface 225 of the die body 220, as shown in FIG. 7B. The top edge of the casing 244 hits the bottom surface of the sleeve 270, as can best be seen in FIG. 7C. Continued upward movement of the plunger 232 tends to move the sleeve/top punch assembly upwards. This compresses the biasing element 256, which resists the upward motion, pushing the bullet 240 into the casing 244 until it is seated. The bullet 240 will be seated to the pre-set depth of D1.

Note that the ability of the sleeve/top punch assembly to move alone the longitudinal axis B while a bullet seating force is applied by the biasing element 256 enables casing 244 and bullet 240 combinations of different lengths to be properly seated. The distance D1 can be altered to change a pre-set seating depth.

Various modifications and additions can be made without departing from the spirit and scope of this invention. Features of each of the various embodiments described above may be combined with features of other described embodiments as appropriate in order to provide a multiplicity of feature combinations in associated new embodiments. Furthermore, while the foregoing describes a number of separate embodiments, what has been described herein is merely illustrative of the application of the principles of the present invention. Additionally, although particular methods herein may be illustrated and/or described as being performed in a specific order, the ordering is highly variable within ordinary skill to achieve aspects of the present disclosure. Accordingly, this description is meant to be taken only by way of example, and not to otherwise limit the scope of this invention.

What is claimed is:

1. A seating die assembly comprising:

a die body comprising:

a longitudinal axis;

a first end surface and a second end surface opposing the first end surface, the first and second end surfaces separated from each other along the longitudinal axis;

an elongated cavity disposed along the longitudinal axis;

a cartridge receiver defining an opening on the first end surface connected to the elongated cavity;

a top punch for seating a bullet in a casing disposed at least partially within the elongated cavity and translatable within the elongated cavity along the longitudinal axis, wherein the top punch includes a bottom surface;

a biasing element disposed within the elongated cavity for urging the top punch toward the cartridge receiver to seat the bullet in the casing; and a seating sleeve disposed at least partially within the elongated cavity and comprising a punch passage and having a bottom surface, wherein the bottom surface of the seating sleeve and the bottom surface of the top punch are separated by a distance along the longitudinal axis, wherein, when a cartridge holder assembly holding a casing having a top edge and containing a bullet having a top portion is moved into the cartridge receiver, the top portion of the bullet engages the bottom surface of the top punch such that the bullet is pushed into the casing until the top edge of the casing engages the bottom surface of the sleeve thereby causing the motion of the casing relative to the bullet and the cartridge receiver to stop so that the distance determines a bullet seating depth of the bullet in the casing.

2. The seating die assembly of claim 1, wherein the biasing element is a spring.

3. The seating die assembly of claim 1, wherein the top punch is disposed within the punch passage, the seating sleeve is translatable within the elongated cavity along the longitudinal axis, and the biasing element is disposed to urge the seating sleeve toward the cartridge receiver.

4. The seating die assembly of claim 3, wherein the bullet seating depth is adjustable by moving the bottom surface of the top punch relative to the bottom surface of the seating sleeve along the longitudinal axis.

5. The seating die assembly of claim 4, wherein the bullet seating depth is adjustable by sliding the top punch within the punch passage along the longitudinal axis.

6. The seating die assembly of claim 3, wherein the die body is mountable on a bullet loading press, the bullet loading press is operable to push a cartridge comprising a casing and a bullet at least partially seated in the casing into the cartridge receiver opening, wherein when the cartridge is pushed into the cartridge receiver opening, a top surface of the bullet impinges on the bottom surface of the top punch, and the top edge of the casing impinges on the bottom surface of the seating sleeve, thereby urging the seating sleeve and the top punch toward the second end of the die body, and a compliant member urges a seating body towards the first end of the die body.

7. The seating die assembly of claim 3, wherein the die body comprises a seating cavity disposed between the elongated cavity and the cartridge receiver for interfacing with the seating sleeve.

* * * * *